US010584495B2

(12) United States Patent
Pavlansky et al.

(10) Patent No.: US 10,584,495 B2
(45) Date of Patent: Mar. 10, 2020

(54) ROOF VENTING SYSTEM

(71) Applicant: Hibco Plastics, Inc., Yadkinville, NC (US)

(72) Inventors: Mark Pavlansky, Yadkinville, NC (US); Keith Pavlansky, Yadkinville, NC (US)

(73) Assignee: Hibco Plastics, Inc., Yadkinville, NC (US)

( * ) Notice: Subject to any disclaimer, the term of this patent is extended or adjusted under 35 U.S.C. 154(b) by 281 days.

(21) Appl. No.: 14/658,603

(22) Filed: Mar. 16, 2015

(65) Prior Publication Data

US 2016/0060872 A1 Mar. 3, 2016

Related U.S. Application Data

(63) Continuation of application No. 10/984,173, filed on Nov. 9, 2004, now abandoned.

(51) Int. Cl.
*E04D 13/17* (2006.01)
*F24F 7/02* (2006.01)

(52) U.S. Cl.
CPC ..... *E04D 13/174* (2013.01); *F24F 7/02* (2013.01)

(58) Field of Classification Search
CPC ..... E04D 13/174; E04D 13/176; E04D 1/36; F24F 7/02
USPC ..... 52/57, 198, 199, 287.1, 288.1, 365, 52/309.1, 309.4, 309.6, 309.8, 169.5
See application file for complete search history.

(56) References Cited

U.S. PATENT DOCUMENTS 4,024,685 A * 5/1977 Aarons ..... E04D 1/30 52/276
4,351,870 A 9/1982 English, Jr. ..... 428/174
4,876,950 A 10/1989 Rudeen ..... 98/42.23
4,924,761 A * 5/1990 MacLeod ..... E04D 13/174 454/365
5,146,646 A 9/1992 Langford et al. ..... 15/210.1
5,252,657 A 10/1993 Frankel et al. ..... 524/460
5,288,269 A * 2/1994 Hansen ..... F24F 7/02 454/365
5,352,154 A * 10/1994 Rotter ..... E04D 13/174 454/365
5,425,672 A * 6/1995 Rotter ..... E04D 1/36 454/365

(Continued)

OTHER PUBLICATIONS

Crest, Crest "Expanding Technology", Dec. 12, 2000, Crest, pp. 1-5. (retrieved from Archive. org).*

(Continued)

*Primary Examiner* — Jessie T Fonseca
(74) *Attorney, Agent, or Firm* — MacCord Mason PLLC

(57) ABSTRACT

A roof venting system for removing warm and moist air from the interior of a building to the outside through a vent opening in the roof. The system includes a vent cover member for placement over the vent opening and two foam members through which the indoor warm and moist air must pass when the air flows from the building interior to the outside. The foam members may be provided with a convoluted surface to facilitate close engagement to the roof profile, and a single piece foam may be used instead of the usual two. The foam and cover members may be flexible, reticulated polyurethane treated with one or more substances to enhance fire resistance and protect from heat/cold adverse weather.

5 Claims, 6 Drawing Sheets

(56) References Cited

U.S. PATENT DOCUMENTS

| | | | | |
|---|---|---|---|---|
| 5,458,538 | A | 10/1995 | MacLeod et al. | 454/365 |
| 5,540,022 | A | 7/1996 | Morris | 52/309.8 |
| 5,548,538 | A | 8/1996 | Grace et al. | 364/571.04 |
| 5,561,953 | A * | 10/1996 | Rotter | E04D 3/30 454/365 |
| 5,651,734 | A | 7/1997 | Morris | 454/365 |
| 5,705,252 | A * | 1/1998 | Lea | A47C 27/144 428/133 |
| 5,706,618 | A | 1/1998 | Pratt | 52/199 |
| 5,772,502 | A | 6/1998 | Smith | 454/365 |
| 5,784,845 | A | 7/1998 | Imeokparia et al. | 52/408 |
| 5,813,176 | A | 9/1998 | Tzeng et al. | 52/198 |
| 5,934,995 | A * | 8/1999 | Morris | E04D 1/36 454/365 |
| 5,979,131 | A | 11/1999 | Remmele et al. | 52/309.9 |
| 6,177,024 | B1 | 1/2001 | Sandoval et al. | 252/62 |
| 6,228,476 | B1 * | 5/2001 | Bogrett | C08J 9/365 428/306.6 |
| 6,308,472 | B1 * | 10/2001 | Coulton | E04D 13/176 428/906 |
| 6,343,985 | B1 * | 2/2002 | Smith | E04D 13/176 454/365 |
| 6,458,029 | B2 | 10/2002 | Morris | 454/365 |
| 8,403,593 | B2 | 3/2013 | Dagesse | 404/41 |
| 8,852,639 | B2 | 10/2014 | MacKay | 424/486 |
| 2001/0032421 | A1 * | 10/2001 | Rotter | F24F 7/02 52/198 |
| 2002/0095882 | A1 * | 7/2002 | Rotter | F24F 7/02 52/199 |
| 2002/0193065 | A1 * | 12/2002 | Morris | E04D 13/176 454/365 |
| 2004/0093812 | A1 * | 5/2004 | Rotter | F24F 7/02 52/199 |
| 2005/0090197 | A1 * | 4/2005 | Coulton | F24F 7/02 454/365 |
| 2005/0126088 | A1 * | 6/2005 | Rotter | E04D 13/176 52/198 |
| 2005/0241248 | A1 * | 11/2005 | Ridenour | E04D 13/174 52/198 |
| 2007/0054612 | A1 * | 3/2007 | Ehrman | F24F 7/02 454/365 |
| 2010/0018137 | A1 * | 1/2010 | Polumbus | E04D 13/174 52/199 |
| 2012/0047828 | A1 * | 3/2012 | Bahn | E04D 13/174 52/199 |
| 2014/0165481 | A1 | 7/2014 | Pavlansky et al. | 52/198 |
| 2014/0223837 | A1 | 8/2014 | Pavlansky et al. | 52/12 |

OTHER PUBLICATIONS

"Reticulated Polyurethane Foam," Crest Foam Industries, Inc., Technical Product Bulletin 101 copyright 1998.

"Reticulated Polyurethane Foam," Technical Product Bulletin 101, copyright 2000.

"Atlas Fasteners for Construction," https://web.archive.org/web/20030822064113/http://www.atlasfasteners.com/closure.htm; Jul. 8, 2003.

"Exterior: Product Selection FAQs", Sherwin-Williams, https://web.archive.org/web/20110807095613/http://www.sherwin-williams.com/pro/problem/faq/ext/produc_sel/index/jsp; copyright 2011.

"Foams Flex Their Muscle on the Road," Product Design and Development, Jan. 2001.

* cited by examiner

ROOF VENTING SYSTEM

BACKGROUND OF THE INVENTION

1. Field of the Invention

The present invention relates to metal roof systems and shingle roof systems that are used in both commercial and residential buildings and, more particularly, to vent coverings which allow for airflow and prevent foreign contaminants such as insects, birds, small animals and excess water from entering a roofing system by forming a partial seal.

2. Description of the Prior Art

The life span of any roof will be increased if adequate ventilation is provided along the top vent of the roof. Ventilation is needed to allow air to flow through and out of the roof interior and out of the vent which is located along the top of the roof where the two slopes of the roof nearly meet. Having adequate airflow that uses roof ventilation is a proven construction technique that is used in both new construction and remodeling existing structures. Ventilation of the roof has been historically accomplished through the use of fabricated metal enclosures and complex fabricated plastic parts. In the 1970's, flexible reticulated polyurethane was used to achieve acceptable airflow and to solve the invasion of foreign debris small animals. While this material solved numerous problems, it still had several troubling shortcomings such as shrinkage, early deterioration, insufficient strength, low ultraviolet resistance, low tear resistance, density and low fire retardancy.

Beginning several years ago and in response to customer requests, research was directed to providing a better venting product than those then in use. Experimentation continued into the year 2000 and thereafter. Different materials were tested, but no acceptable version was identified until a few years ago when it was determined that reticulated polyurethane had the essential characteristics needed for a successful venting system. Later it was determined that this material when used would quickly begin to degrade because of poor ultraviolet resistance, poor hydrolytic stability, and the inability to meet building codes as a fire-retardant material used in construction.

More recently, a new, flexible, reticulated, polyurethane material was produced and, when tested, verified that it would prevent excess water from being driven by wind back through the ventilation material and into the roof interior. It was designed to withstand ultraviolet radiation for prolonged periods, and it was also designed to comply with building material standards and made fire resistant. The material proved successful and demonstrated that it would provide superior airflow for a roof and prevent wind-driven rain from entering the building. Thus an improved vented closure strip has been and continues to be very desirable, and it is to that end that the present invention is directed.

OBJECTIVES AND SUMMARY OF THE INVENTION

A primary objective of the present invention is to provide a roof venting system that has all of the advantages of prior art devices and more, and none of the disadvantages.

Another objective of the present invention is to enhance the outward flow of air from the region beneath the roof and at the same time inhibit the inward passage of moisture and insects.

Yet another objective of the present invention to provide a vent cover which engages a pair of laterally spaced open cell members so that air can freely flow outwardly therethrough while the entry of moisture and insects in a reverse direction is inhibited.

Still another objective of the present invention to provide foam members having a multiplicity of interconnected open pores so that maximum airflow is achieved and at the same time an optimum restriction to moisture and insects in an reverse direction is realized even when the moisture is in the form of wind-driven rain.

A further objective of the present invention is to provide a roof venting system that is readily conformable to the slope of the roof to which it is attached.

Yet another objective of the present invention is to provide sections of predetermined length, yet enabling any section to be cut to a lesser length during installation, such as when the last section must be shortened to match an end of the roof.

Yet another objective of the present invention is to provide a system having longevity through heat/cool cycles.

Still another objective of the present invention is to provide a system having hydrolytic stability.

A further objective of the present invention is to provide a system that will withstand oxidation.

Still another objective of the present invention is to provide an inexpensive roof vent system which will be virtually maintenance-free.

The invention in it broadest form is a roof venting system for covering a vent opening in the roof extending substantially for the length of the roof ridge permitting ventilation from the interior space under the roof to the exterior. The system includes a vent cover covering the vent opening extending over the opening for the length of the opening and overlapping the opening substantially evenly on each side. A pair of laterally-spaced, flexible, reticulated polyurethane foam members have first and second faces, the second faces engaging one side of the vent cover and the first faces engaging the roof profile.

Thus there has been outlined the more important features of the invention in order that the detailed description that follows may be better understood and in order that the present contribution to the art may be better appreciated. There are, of course, additional features of the invention that will be described hereinafter and which will form the subject matter of the claims appended hereto. In that respect, before explaining at least one embodiment of the invention in detail, it is to be understood that the invention is not limited in its arrangement of the components set forth in the following description and illustrated in the drawings. The invention is capable of other embodiments and of being practiced and carried out in various ways.

It is also to be understood that the phraseology and terminology employed herein are for the purpose of description and should not be regarded as limiting in any respect. Those skilled in the art will appreciate that the concept upon which this disclosure is based may readily be utilized as a basis for designing other structures, methods and systems for carrying out the several purposes of this development. It is important that the claims be regarded as including such equivalent methods and products resulting therefrom that do not depart from the spirit and scope of the present invention. The application is neither intended to define the invention, which is measured by its claims, nor to limit its scope in any way.

Thus, the objectives of the invention set forth above, along with the various features of novelty which characterize the invention, are noted with particularity in the claims annexed to and forming a part of this disclosure. For a better understanding of the invention, its operating advantages and the specific results obtained by its use, reference should be made to following detailed specification taken in conjunction with the accompanying drawings wherein like characters designate like parts throughout the several views.

The drawings are included to provide a further understanding of the invention and are incorporated in and constitute a part of this specification. They illustrate embodiments of the invention and, together with their description, serve to explain the principles of the invention.

DESCRIPTION OF THE PREFERRED EMBODIMENT

Figure 1:
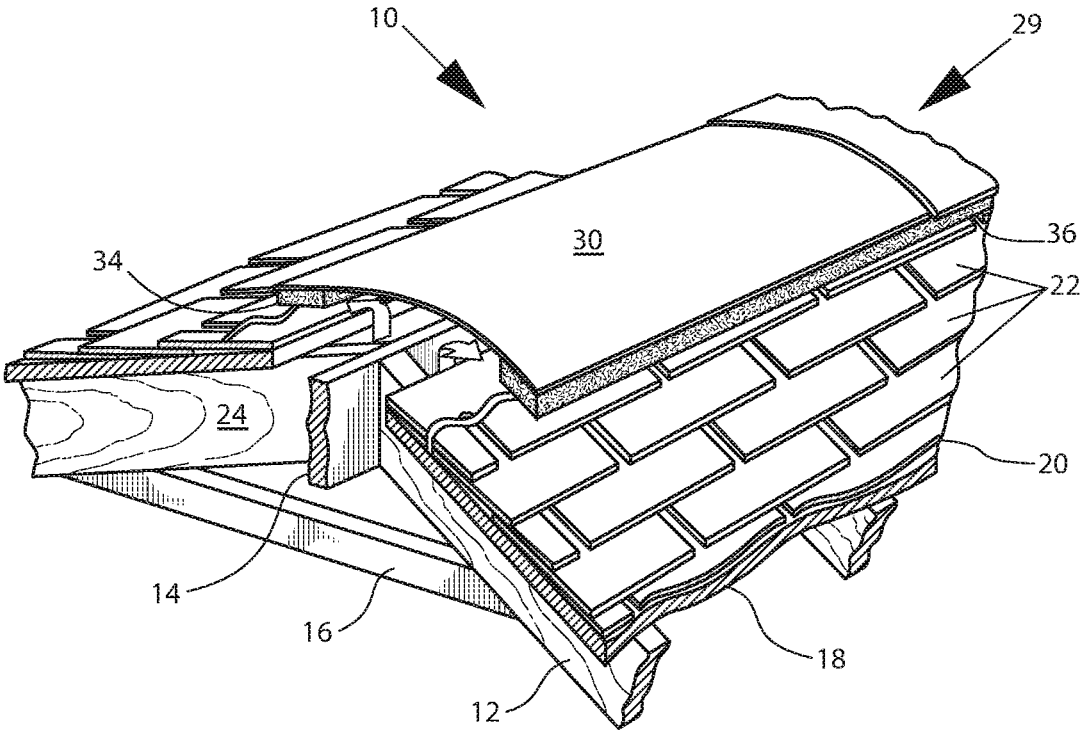
FIG. 1 is a perspective, fragmentary view of the venting system of the present invention including the vent cover member, the foam members and the roof opening in a shingled roof.
Figure 2:
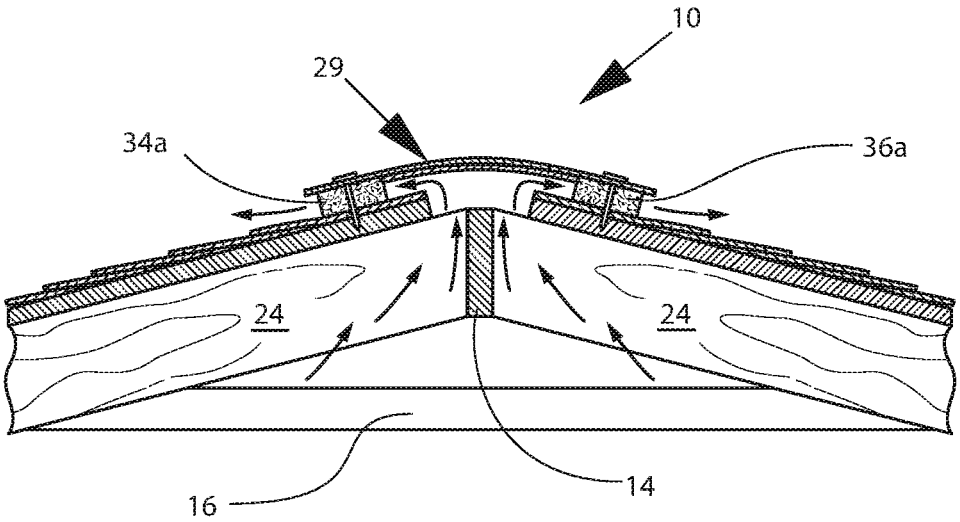
FIG. 2 is an end elevational, partial view of the structure shown in claim 1.
Figure 3:
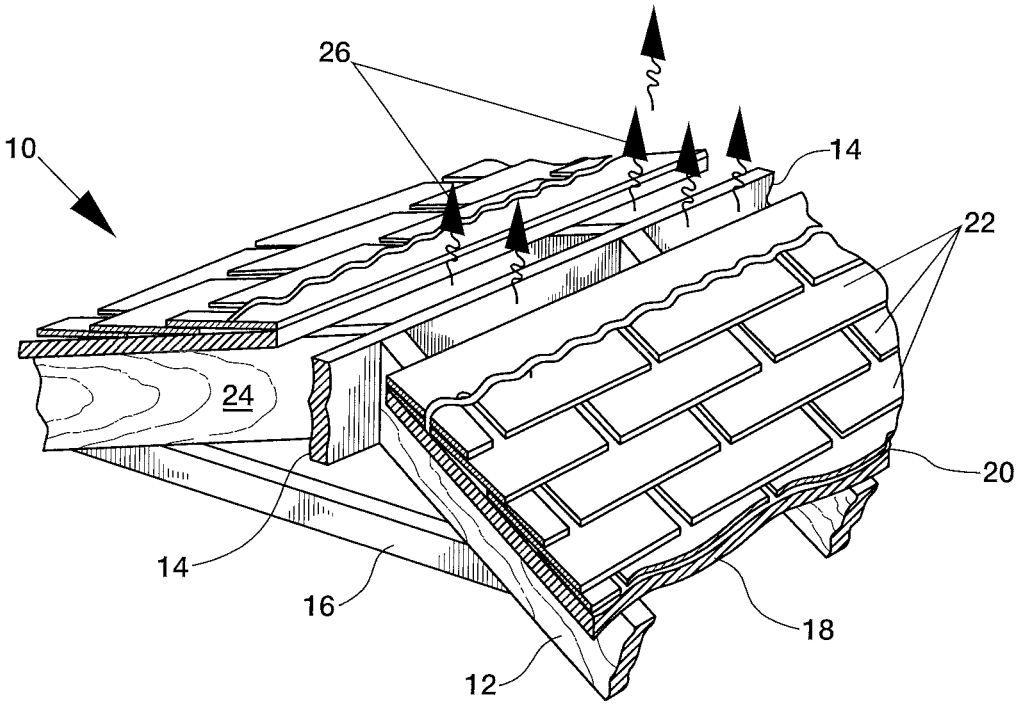
FIG. 3 is a perspective and fragmentary view of the structure shown in FIG. 1 without the presence of the vent cover member and spaced-apart foam members.
Figure 4:
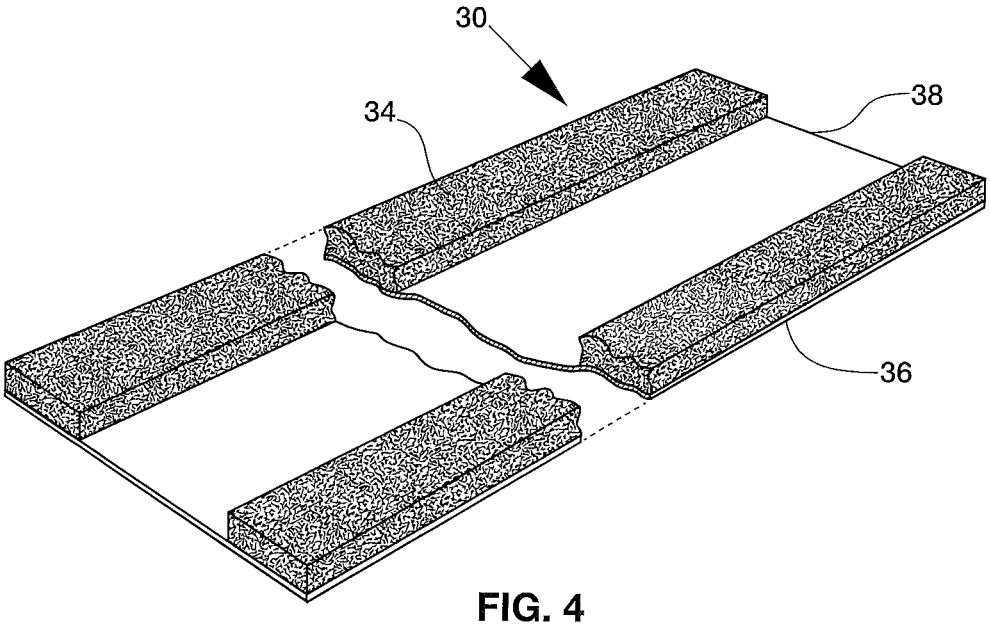
FIG. 4 is perspective, fragmented and isolated view of the foam members engaging the strip.
Figure 5:
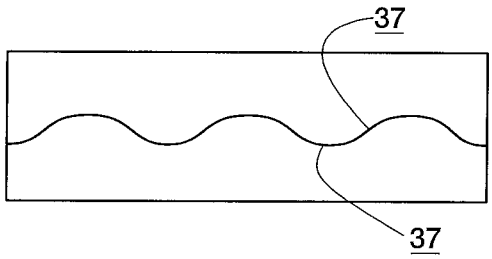
FIG. 5 is a an end elevational view of two foam member having convoluted engaging surfaces made by cutting a single piece of foam.

The present invention is more conveniently used with conventional sloping roofs such as are shown in FIGS. 1, 2 and 3 wherein a portion of one such roof shown generally as 10 includes rafters 12 and a ridge member 14 placed within the upper ends of rafters 12 and a collar beam 16 extending horizontally between each pair of rafters. Some roofs employ a truss construction not requiring a ridge member, and this roof is equally compatible with the invention. Sheathing 18 overlies rafters 12, and over sheathing 18 is placed a layer of felt or building paper 20. Roof shingles 22 are nailed through the felt 20 into sheathing 18. A vent opening 24 permits the upward and outward flow of air in the direction of the arrows 26 (FIG. 3) from the region beneath roof 10 such as an attic. Various vents (not shown) in the lower portion of the attic permit the ingress of air so that normal airflow is upwardly and outwardly through vent opening 24 as indicated by arrows 26.

Figure 11:
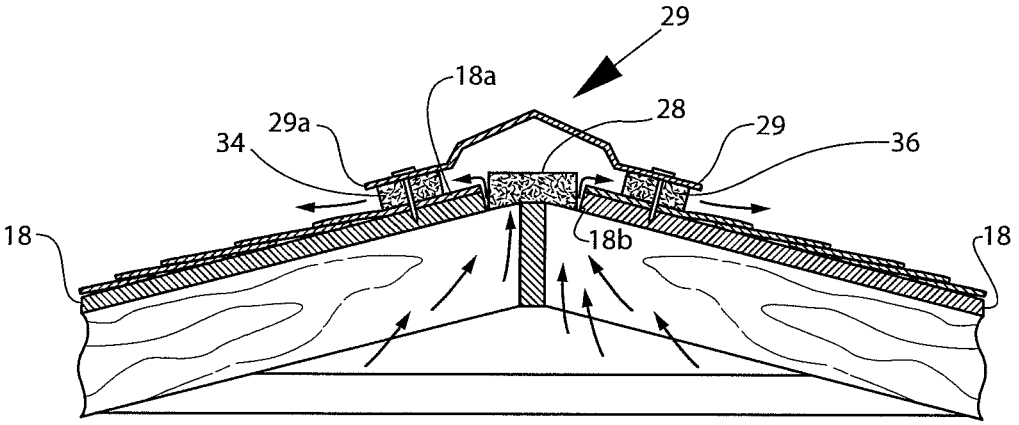
FIG. 11 is an end elevational and fragmentary view of the structure similar to that shown in FIG. 10 which has a ridge cap covering the ridge gable and the foam material segments.

The primary embodiment of the present invention is illustrated in FIGS. 9, 10, 11 and 12. A foam member 28 is positioned between and slightly over the outside edges of sheathing upper edges 18*a* and 18*b* and substantially covers vent opening 24. Additional foam members 34, 36 are positioned on both sides of member 28 as shown in FIG. 11. A ridge cap 29 is used to cover the ridge gable as shown in FIG. 11, and the free ends 29*a*, 29*b* of cap 29 rest on members 34 and 36. Cap 29 preferably is formed from a single piece of material and is secured to sheathing 18 by screws, rivets or nails.

Figure 12:
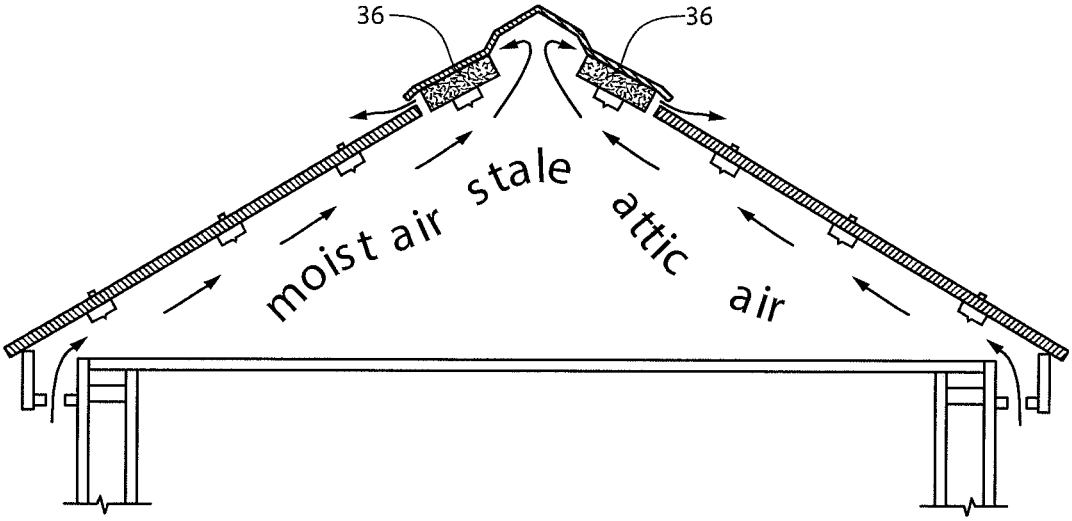
FIG. 12 is an end elevational and diagrammatic view of the attic of a building showing the airflow entering the building and passing through the attic and back to the outside through the foam segments on each side of the ridge cap.

Airflow within the system is shown in FIG. 12 where cool airflow from outside the building passes into the attic and replaces the moist and stale attic air which is moved to the outside through foam members 34, 36. Vent cover 28 and foam members 34, 36 are formed in predetermined lengths such as eight-foot or twenty five-foot sections.

Another embodiment of the present invention is shown in FIGS. 1, 2, 3 and 4. Here a vent cover 30 is formed from a lightweight close-cell plastic such as reticulated polyurethane. The width of section 30 is approximately one foot and its thickness is approximately 0.5 to 1.5 inches. Its density can be approximately to 1.7 pounds per cubic foot uncoated and 1.2 to 4 pounds per cubic foot coated. Member 32 is sufficiently flexible to readily conform to the slope or pitch of the roof as can be seen in FIG. 1 and FIG. 2.

The foam members 34, 36 of the primary embodiment and 34*a*, 36*a* of the second embodiment are laterally spaced with respect to each other in each embodiment to provide an intermediate space 38. All members are formed of flexible, reticulated, open cell foamed plastic. The form's structure has numerous walls made of very thin polyurethane polymers. These walls are referred to as cell membranes. Cell membranes, even though they may be ruptured, block the free passage of air or fluids through the foam. After the foam has been produced, the cell membranes can be affected during a post thermal treating process. The very thin cell membranes are vaporized during this thermal treating process and leave only the foam strands or struts. The reticulation of polyurethane foam occurs as it is subjected to a proprietary process inside a specially designed vessel using heat and pressure to create flexible foam structures without cell membranes. The pentagonal dodecahedron, a geometric shape with 12 plane faces, is the natural structure of reticulated foam cells. The resulting fully open pore structure is now a reticulated foam which is highly permeable to the flow of air. The size of the open pores in the foam can be precisely controlled to allow void volumes up to 98%. The size of the pores and ruptured control the level of air permeability and determine the suitability of the foam to allow proper air flow, and the pores per inch ("PPI") that work most effectively are in a range of 8 to 32 PPI.

The use of open cell members 34, 36, 34*a* and 36*a* function quite well to permit an unrestricted flow of air. The resistance to airflow is minimal. There is a need for an easy passage of air from beneath the roof, yet there is need for an effective resistance to the entrance of moisture, particularly wind-borne and snow, through members 34, 36, 34*a* and 36*a*. The presence of very fine interlinked filaments or strands prevent moisture from entering the building from the outside, even when the moisture is wind-driven, for the moisture collects on the various filaments or strands instead of entering the building.

While foam members 34, 36, 34*a* and 36*a* can be made as described, they would not have the ability to stand up to weathering (heat and cold) exposure. To overcome these shortcomings, coatings have been developed to prevent early disintegration and extend the life of this material. Coating the formed foam members with an acrylic latex such as provided as a straight up coating under the name Paranol AA-G-72 will extend product life cycle indefinitely during heating and cooling cycles, help reduce flame spread and enhance ultraviolet resistance. Coating the foam members with this chemical will prevent early breakdown of the foam due to exposure to sunlight. The acrylic polymer is naturally a superior molecular structure. The molecular bond formed in the acrylic is inherently resistant to ultraviolet radiation, and testing of this product to ASTM G53 criteria at 1000 hours has resulted in no visual surface degradation.

The foam members can be coated with a fire retardant substance containing or formed from antimony oxide that will prevent the spread of flames. In particular, another fire retardant derivative Decabromodiphenyl is a halogen, and as it burns, bromine molecules are released that push or force oxygen molecules away from the coating and thereby prevent oxygen from fueling the fire. This molecular composition has been known for many years.

The flexible reticulated polyurethane polymer foam can be produced in a basic version that will result in foam material having ultraviolet and flame resistant features without the application of any coating or before a coating is applied.

Foam members 34, 36, 34*a* and 36*a* are flexible and therefore will conform to contoured or corrugated surfaces without having to be cut to match the building or roof profile. The soft, flexible, conformable foam is pressed into the various contour panels and filling voids while still remaining porous.

Figure 6:
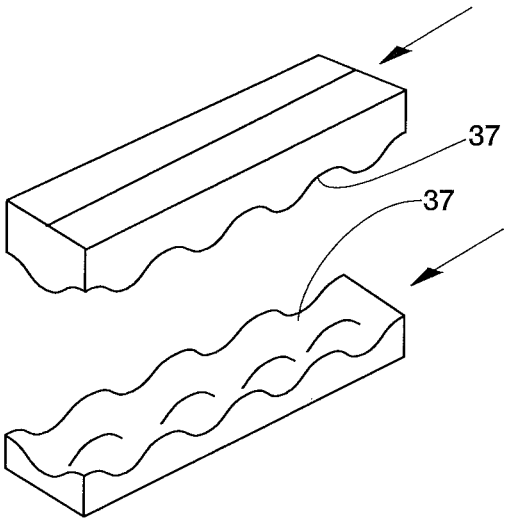
FIG. 6 is a perspective view of the foam members with convoluted engaging surface spaced from each other.

Foam members 34, 36, 34*a* and 36*a* are made in a flat configuration that will be useable in many situation since the flat bottom surface will conform to many roof profiles. Another very important design consideration involves cutting the foam block into two separate pieces with a slitting device outfitted with a convolution roller to form convoluted surfaces on both cut foam surfaces. These foam convoluted surfaces readily conform to multiple structural profiles while making the passage of air therethrough even more efficient. See FIG. 6 and FIG. 7. The convoluting cutting process leaves "egg crate" looking peaks and valleys in the convoluted surfaces.

Figure 7:
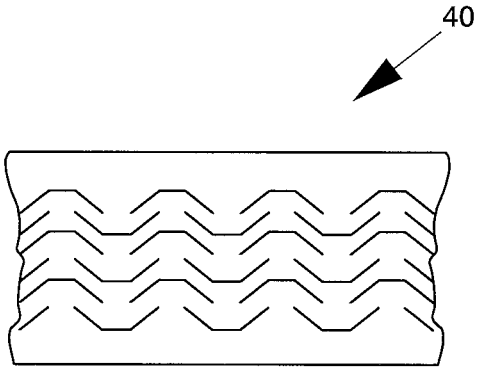
FIG. 7 is a plan view of a single expandable foam member in a cut but unexpanded condition.
Figure 8:
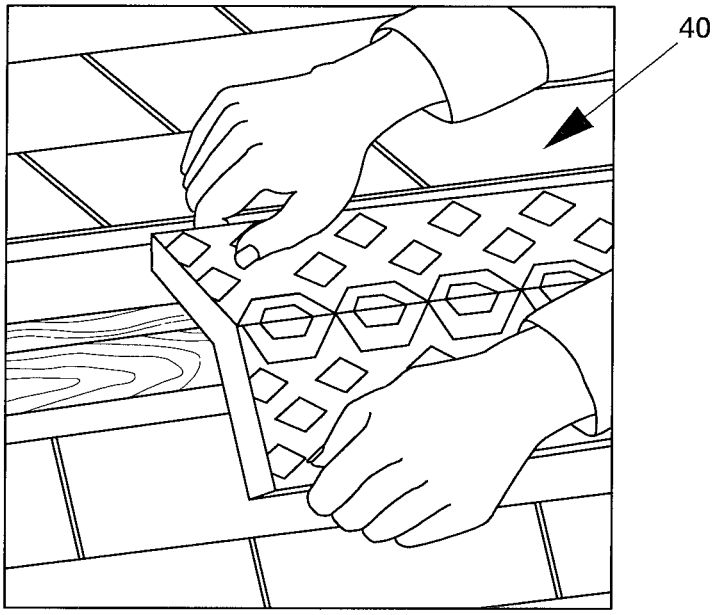
FIG. 8 is a perspective view of the form member shown in FIG. 7 in the cut and expanded condition being applied to a building over the ridge gable.
Figure 9:
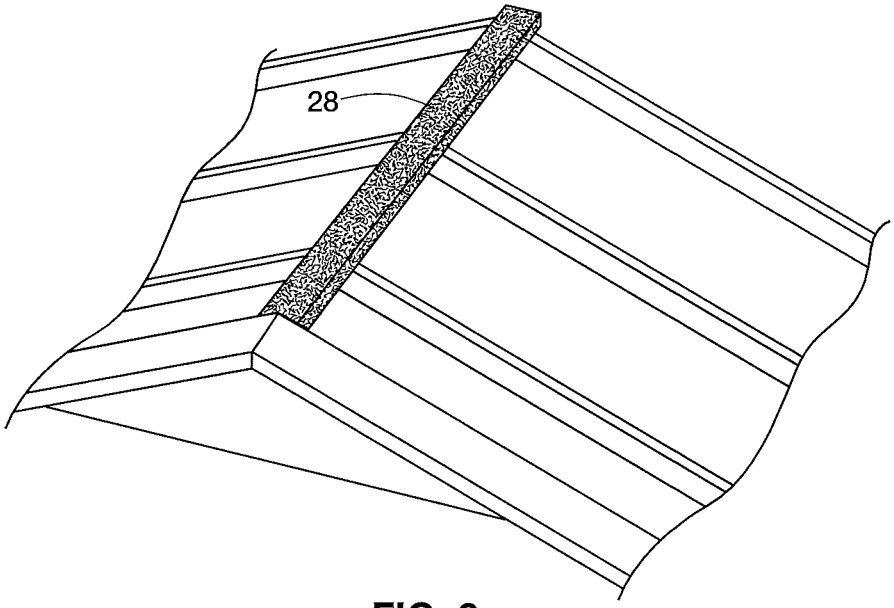
FIG. 9 is a perspective and fragmentary view of another embodiment of the present invention showing the placement of foam material over, in and for the length of the ridge vent.
Figure 10:
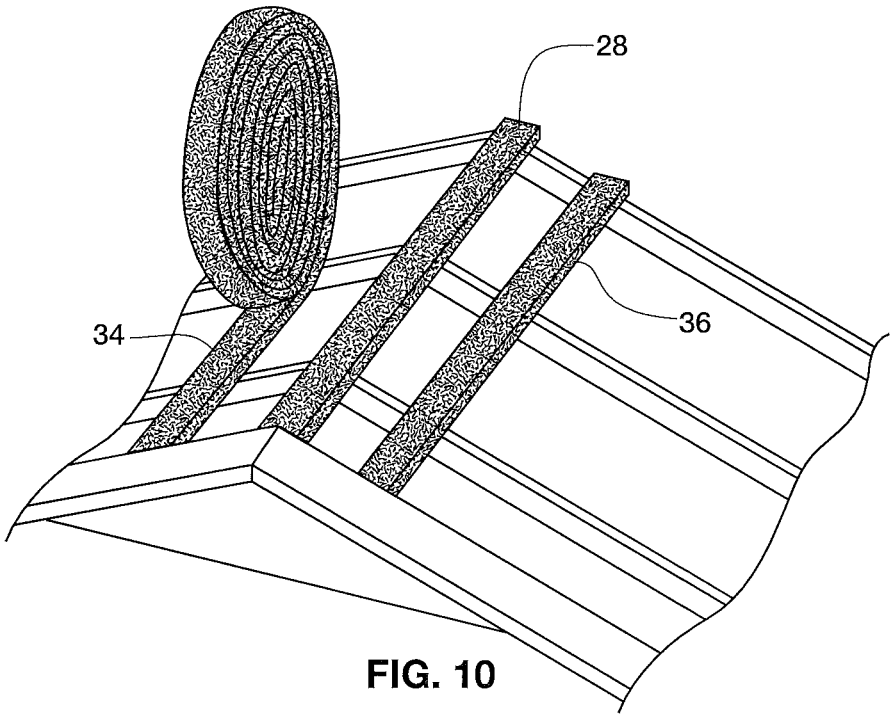
FIG. 10 is a perspective and fragmentary view of the structure shown in FIG. 9 wherein two additional segments of foam material are positioned, one on each side of the ridge gable and the previously installed first segment of foam material.

An alternative embodiment of foam members 34, 36, 34*a* and 36*a* is the provision of a single expandable foam member 40 shown in FIG. 7 and FIG. 8. Member 40 is cut as shown in FIG. 7 and then pulled laterally in an expansive manner to produce the expanded member 40 shown in FIG. 8. This results in a user friendly single member 40 that requires less raw material while still providing superior ventilation.

During application to commercial, residential, other buildings and other structures, adhesive may be applied evenly along the entire length of the foam member material strip or roll. Conventional application has been to apply adhesive only in the valley's of fabricated vent material. The application of an adhesive to any of the foam members to securely engage them on the on either side with either the roof profile or the membrane is discretionary and subject to the direction of the construction director. In many cases, no adhesive is used.

From the preceding description, it can be seen that a roof venting system has been provided that will meet all of the advantages of prior art devices and offer additional not heretofore achievable. With respect to the foregoing invention, the optimum dimensional relationship to the parts of the invention including variations in size, materials, shape, form, function, and manner of operation, use and assembly are deemed readily apparent to those skilled in the art, and all equivalent relationships illustrated in the drawings and described in the specification are intended to be encompassed herein.

The foregoing is considered as illustrative only of the principles of the invention. Numerous modifications and changes will readily occur to those skilled in the art, and it is not desired to limit the invention to the exact construction and operation shown and described. All suitable modifications and equivalents that fall within the scope of the appended claims are deemed within the present inventive concept.

What is claimed is:

1. A roof venting system for covering a vent opening in a roof extending substantially the length of a roof ridge permitting ventilation from an interior space under the roof to an exterior, the system comprising:

a vent cover member covering the vent opening over the length of the opening; and at least one flexible, reticulated polyurethane foam member having first and second faces, the second face engaging one side of a covering strip and the first face engaging a roof profile, wherein the first face of the at least one foam member has convoluted surfaces to facilitate the conformation of the convoluted surfaces to the roof profile.

2. The system as claimed in claim 1, wherein the at least one foam member is fire retardant and ultraviolet resistant.

3. The system as claimed in claim 1 wherein the at least one foam member is homogeneously formed with pores per inch within the range of from 8 to 32.

4. The system as claimed in claim 1 wherein the at least one foam member is coated with flame retardant resistant acrylic latex.

5. The system as claimed in claim 1 wherein the at least one foam member is adapted to elongate to a predetermined length along the roof ridge and overlapping the vent opening.

* * * * *